US008367992B1

(12) United States Patent
Patel et al.

(10) Patent No.: US 8,367,992 B1
(45) **Date of Patent: *Feb. 5, 2013**

(54) AIRCRAFT, MISSILE, PROJECTILE, OR UNDERWATER VEHICLE WITH RECONFIGURABLE CONTROL SURFACES

(75) Inventors: Mehul Patel, Chandler, AZ (US); T Terry Ng, Sylvania, OH (US); Alan B Cain, Saint Louis, MO (US); Zak Sowle, Cleveland, OH (US); Jack DiCocco, Medina, OH (US)

(73) Assignee: Orbital Research Inc., Cleveland, OH (US)

( * ) Notice: Subject to any disclaimer, the term of this patent is extended or adjusted under 35 U.S.C. 154(b) by 224 days.

This patent is subject to a terminal disclaimer.

(21) Appl. No.: 12/977,519

(22) Filed: Dec. 23, 2010

Related U.S. Application Data

(63) Continuation of application No. 12/077,447, filed on Mar. 19, 2008, now Pat. No. 7,880,125, which is a continuation of application No. 11/292,972, filed on Dec. 2, 2005, now Pat. No. 7,709,772.

(51) Int. Cl.
*F42B 10/02* (2006.01)
*B64C 3/54* (2006.01)

(52) U.S. Cl. ..... 244/3.25

(58) Field of Classification Search ..... 244/3.24–3.26, 244/87, 218; 102/348, 490; 114/21.1, 23
See application file for complete search history.

(56) References Cited

U.S. PATENT DOCUMENTS 2,401,853 A * 6/1946 Bailey ..... 244/3.25
2,597,703 A * 5/1952 Busacker ..... 244/3.25
2,937,824 A * 5/1960 Krumbholz et al. ..... 244/3.25
2,992,794 A * 7/1961 Boyd ..... 244/3.15
3,132,590 A * 5/1964 Hall ..... 244/3.19
3,141,409 A * 7/1964 Travis et al. ..... 102/399
4,145,017 A * 3/1979 Stiklorus ..... 244/3.25
4,722,496 A * 2/1988 Herrmann et al. ..... 244/3.25
5,014,931 A * 5/1991 Mikhail ..... 244/3.25
5,141,175 A * 8/1992 Harris ..... 244/3.25
5,150,858 A * 9/1992 Hopwell et al. ..... 244/45 A
6,152,041 A * 11/2000 Harris et al. ..... 102/384
6,454,205 B2 * 9/2002 Niemeyer et al. ..... 244/3.26
6,540,176 B2 * 4/2003 Davis et al. ..... 244/3.24
6,548,794 B2 * 4/2003 Facciano et al. ..... 244/3.1
6,892,981 B2 * 5/2005 Lipeles ..... 244/13
6,910,661 B2 * 6/2005 Dockter et al. ..... 244/218
7,070,144 B1 * 7/2006 DiCocco et al. ..... 244/3.21

* cited by examiner

*Primary Examiner* — Joseph W Sanderson

(74) *Attorney, Agent, or Firm* — Brian M. Kolkowski; Robert K. Schmidt

(57) ABSTRACT

The present invention relates to an aircraft, missile, projectile, or underwater vehicle with an improved control system and a method for increasing the maneuverability or stability of an aircraft, missile, projectile, or underwater vehicle. More particularly, the present invention relates to a method for increasing the maneuverability or stability of an aircraft, missile, underwater vehicle or projectile through the use of removable control surfaces. The technical advantage of the removable control surface system (or "removable control surface") over other systems is that the removable control surface system enables the aircraft, missile, underwater vehicle or projectile to have two or more design configurations, each configuration being tailored to the aircraft, missile, projectile, or underwater vehicle's specific stability or maneuverability requirements during a specific portion of the flight.

19 Claims, 6 Drawing Sheets

AIRCRAFT, MISSILE, PROJECTILE, OR UNDERWATER VEHICLE WITH RECONFIGURABLE CONTROL SURFACES

CROSS REFERENCE TO RELATED APPLICATIONS

The application is a continuation of U.S. patent application Ser. No. 12/077,447, filed on Mar. 19, 2008, now U.S. Pat. No. 7,880,125, which is a continuation of U.S. patent application Ser. No. 11/292,972 filed on Dec. 2, 2005, which issued as U.S. Pat. No. 7,709,772 on May 4, 2010.

The U.S. Government has a paid-up license in this invention and the right in limited circumstances to require the patent owner to license others on reasonable terms provided for by the terms of contract Number FA8650-04-M-1646 issued by the United States Air Force, Wright-Patterson Air Force Base.

BACKGROUND OF THE INVENTION

1. Field of the Invention

The present invention generally relates to an aircraft, missile, projectile, or underwater vehicle with an improved control system, and to an improved control system by itself for maneuvering these aircraft, missile, projectile or underwater vehicle. More particularly, the present invention relates to removable, and variable control surfaces for adaptively modifying the aircraft missile, projectile or underwater vehicle's stability which also affects the maneuvering performance, in-flight.

2. Technical Background

The ability to adaptively modify and control a vehicle's static and dynamic stability in-flight has vast potential in diverse aeronautical and underwater applications including extreme vehicle maneuvering, collision avoidance, collision seeking, end-game maneuvering, stall prevention, and managing aerodynamic forces and moments. There is no doubt, that in the era of growing aeronautical and aerospace use, air vehicles with fast-acting control surfaces and methodologies that allow dynamic, in-flight reconfiguration of the vehicle's stability and aerodynamic performance are critical to the success and development of the next-generation, high-performance vehicles. Examples include weapons that are designed to seek-and-destroy moving and emerging high-priority targets, active flares that are deployed from aircraft to defend against enemy missiles, or fighter aircraft that need rapid maneuvering capabilities during dog-fighting. In general, it is highly desirable to have an aircraft, missile, projectile, or underwater vehicle be able to readjust its path in a quick and effective manner. In the case of missiles or projectiles, it is not only desirable but necessary to possess the ability to actively adjust the vehicle stability and maneuverability in-flight so as to sustain high loads during launch and to pursue moving targets, respectively.

Stability and maneuverability are functions of the relative positions of center of gravity and center of pressure. The center of pressure is determined by the relative placement of surface area. As the fluid flows over the surface, it exerts pressure upon that surface. By integrating the total pressure around the vehicle, the net force and moment is determined, which defines the vehicle's stability. With more pressure towards the rear of the vehicle, the center of pressure moves towards the rear, and vice versa. The vehicle's center of gravity is based upon the weight distribution, in that the more weight towards the front or the back of the vehicle will correspondingly alter the center of gravity towards the front or back, respectively. The further the center of pressure is located aft of the center of gravity, the greater the stability it provides to the vehicle. Alternatively, reducing the distance between the center of mass and the center of pressure leads to a less stable, and hence, a more maneuverable vehicle. Consequently, to create a more stable vehicle, control surfaces are typically placed near the rear, behind the center of gravity. This increase in stability however leads to a less maneuverable configuration.

The trade-off between stability and maneuverability is always a challenging assessment in the case of vehicles that require both 'stable flight' and 'supermaneuverability' during different stages of their flight envelope. An example of such a vehicle is a small rocket-powered flare or a projectile that is used as a defensive countermeasure for aircraft against enemy missiles. For a successful employment of such a countermeasure system, the flare needs to be fired from an aircraft in such a way that it can be maneuvered into the path of the incoming missile for physical interception and destruction. This style of execution requires both heightened stability and supermaneuverability, which is uncharacteristic of traditional flares or air vehicles.

Additional problems with control surface designs arise when a missile or projectile must be fired at an angle from a fast moving aircraft. A missile or projectile fired at an angle from a quickly moving aircraft must be extremely stable to overcome the high cross-winds and yawing moment during the launch phase. Inadequate stability will result in the missile or projectile tumbling out of control shortly after launch. Air-to-air and air-to-ground missiles are normally fired in the same direction the aircraft that launched it is flying. Any change in direction away from that of the aircraft from which it was fired, occurs after the missile or projectile is in flight. This eliminates any cross winds caused by the forward motion of the aircraft as the winds will be parallel with the bodies of the aircraft and missile or projectile. However, when an air-to-air or air-to-ground missile is fired at any angle not directly forward or directly backwards of the aircraft (0 and 180 degrees respectively), they are subject to crosswinds generated by the forward movement of the aircraft. The higher the launch angle is away from 0 or 180 degrees, the greater the crosswinds. The crosswinds will increase approaching 90 degrees from forward where they will be greatest, and decrease approaching 180 degrees where they will return to 0. Overcoming the cross-winds and yawing moment requires large control surfaces for stability. But a missile or projectile with large control surfaces will not be able to adequately maneuver because its large control surfaces place its center of pressure far behind its center of mass. This problem has thus far prevented large scale use of aircraft-launched missiles or projectiles that are launched at an angle.

Creating vehicles with high stability and maneuverability has long been a goal in the art, and has been accomplished by a number of means. Canards, elevators, ailerons, elevons and other forms of control surfaces are typically used to provide control and stability. However, most vehicles have a single-point design, where the design of the aerodynamic control system is optimized for the conditions likely to be encountered for the majority of the vehicle's flight path. To design vehicles that are both stable as well as maneuverable, multi-point designs involving adaptive, in-flight modifications to the control surfaces are proposed.

In view of the foregoing inherent disadvantages with presently available aircraft, missile, projectile, and underwater vehicle control devices, it is an object of the present invention to develop a system and a methodology for allowing these vehicles to transition from one configuration to another configuration using removable control surfaces.

It is a further object of this invention to provide a molting control surface of the character described wherein the molting pieces are detached in-flight to modify the aircraft, missile, projectile or underwater vehicle's stability, drag, or its ability to turn in the pitch, yaw, and roll axes.

SUMMARY OF THE INVENTION

The present invention relates to an aircraft, missile, projectile, or underwater vehicle with an improved control system, and to an improved control system for maneuvering an aircraft, missile, projectile, or underwater vehicle. More particularly, the present invention relates to an aircraft, missile, projectile, or underwater vehicle with removable and variable control surfaces for adaptively modifying the vehicle's stability which also affects the maneuvering performance, in-flight The technical advantage of an adaptive or a removable control surface system (or "removable control surface") over other systems is that the removable control surface system enables the aircraft, missile, projectile or underwater vehicle to have multi-point designs, where two or more different stability-configurations are possible, and each configuration is custom-tailored to enhance performance during a particular stage of the flight envelope. Most current vehicle control systems are usually designed to provide optimal performance at a single-point design condition, for example cruise condition for transport aircraft. The primary configuration of the removable control surface system of the present invention contains all of the control surfaces attached to the vehicle. The primary configuration is the configuration in which the aircraft takes off, or in the case of a missile or projectile, it is the configuration during launch. When the vehicle's requirements for maneuvering changes during a particular stage of its flight, all or portions of the control surfaces are detached to yield to a secondary less-stable but more-maneuverable configuration.

If only portions of control surfaces are to be released, the control surfaces attach to the body of the vehicle by the same type of connector as used with non-releasable control surfaces. If the entire control surface releases from the body of the aircraft, missile, projectile or underwater vehicle, a connecting mechanism or connector is used to connect the control surface to the body. Such connecting mechanism or connector must be releasable. Preferably such a mechanism should be releasable by triggering an actuator. Such connecting mechanism or connector for example can include, but is not limited to adhesives, exploding bolts, mechanical weaknesses, clamps, and hinges. Once removed, the control surface or portion of the control surface cannot normally be reattached unless the aircraft, missile, projectile or underwater vehicle is reusable. In order to maintain control and avoid undesired vehicle dynamics, equal lift and/or pressure on the aircraft, missile, underwater vehicle or projectile, opposite or all control surfaces (e.g. fins, wings, rudders, etc.) preferably all surfaces are removed at the same time to maintain equal lift and/or pressure on opposite sides.

Releasing the removable control surfaces is conducted by a control system situated either inside the mother vehicle (the launcher) or inside itself. The control system monitors parameters from sensor or device outputs and analyzes the data to determine whether any changes to the stability of the aircraft, missile, underwater vehicle or projectile dynamics need to be made. Sensors or devices feeding data into the control system can be located on the launch vehicle, aircraft, missile, underwater vehicle or projectile body; a control surface such as a wing; or located remotely. If the sensor or device is located remotely, the sensor output must be transmitted to a receiver on the vehicle. Devices for example can include, but are not limited to GPS, radar, altimeter, barometer, IR, RF, and transmitter beacons. Sensors for example can include, but are not limited to position, speed, distance, airflow, and pressure sensors. The output of the sensors or devices is used to determine when the control surfaces must be removed or not. For example, if a missile's IR detection system determines that an aircraft has just commenced an evasive maneuver, the control system on the missile could release the removable control surfaces to make it more maneuverable in order to better position the missile to make final contact with the aircraft. The control system can take the form of a closed loop control system such as a PID system, computer or other means.

The removable control surfaces or portions of the control surfaces of the present invention have two configurations; attached and detached. However, the control surface detachment points can be located at numerous places on the aircraft, missile, underwater vehicle or projectile or on the non-removable portions of the control surface. For example, if the detachment point is at the connection point of the control surface and the body, the entire control surface can be removed. Alternatively, if the connection point is located on the control surface, only a portion of the control surface can be removed. There can also be multiple connection points on a single control surface allowing portions of the control surface to be individually removed. Separately removing portions of or entire control surfaces will result in multiple configurations and varying degrees of stability.

The number of control surfaces that are removed is also variable according to the specific purposes of the aircraft, missile, underwater vehicle or projectile. Any, all or none of the control surfaces can be removed. For example if input from a cruise missile's GPS informs the controller that the missile is moving within range of a surface-to-air missile battery, but no missile has been fired, the cruise missile can remove two of its four control surfaces in anticipation of evasive maneuvers that it will likely have to perform. Yet a further example of removing additional control surfaces is if that same cruise missile's RF sensor detects a missile launch from the surface-to-air battery. The cruise missile will then remove the remaining two of the original four control surfaces to gain maximum maneuverability.

In one embodiment, the present invention includes an aircraft, missile, projectile, or underwater vehicle comprising a body and at least one control surface, wherein the at least one control surface is reduced or eliminated by removing at least part of the at least one control surface.

In another embodiment, the present invention is an aircraft, missile, projectile, or underwater vehicle: a body; at least one control surface; and at least one sensor having an output; wherein the at least one control surface is reduced or eliminated by removing at least part of the at least one control surface; based upon the output the at least one sensor.

In still another embodiment, the present invention is a missile comprising a body and at least one control surface, wherein the shape of the at least one control surface is reconfigurable and adaptable in flight In still another embodiment, the present invention is a missile comprising a body and at least one control surface wherein the area of the at least one control surface can be increased or decreased in flight.

In still another embodiment, the present invention is a missile comprising a body at least one control surface and at least one sensor with an output, wherein the shape of the at least one control surface is reconfigurable in flight based in part on the output of at least one sensor.

In still another embodiment, the present invention is a missile comprising a body at least one control surface and at least one sensor with an output, wherein the area of the at least one control surface can be increased or decreased in flight based in part on the output of at least one sensor.

In still another embodiment, the present invention is a missile comprising a body, at least one control surface, at least one sensor with an output and a closed-loop control system, wherein the closed-loop control system actuates the change in shape of the at least one control surface based in part on the output of the at least one sensor.

In still another embodiment, the present invention is an aircraft, missile, projectile, or underwater vehicle comprising a body and at least one control surface, wherein all or part of the at least one control surface is removed to reduce the drag of the vehicle.

In still another embodiment, the present invention is a aircraft, missile, projectile, or underwater vehicle comprising a body and at least one control surface, wherein all of the at least one control surfaces are removed to reduce the drag of the vehicle, leading to a final configuration having no control surfaces.

In even yet another embodiment, the present invention includes a missile comprising a body, at least one control surface, at least one sensor with an output and a closed-loop control system, wherein the closed-loop control system actuates the increase or decrease in the area of the at least one control surface based in part on the output of the at least one sensor.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and together with the description serve to explain the principles and operation of the invention.

DESCRIPTION OF THE PREFERRED EMBODIMENT(S)

Figure 1:
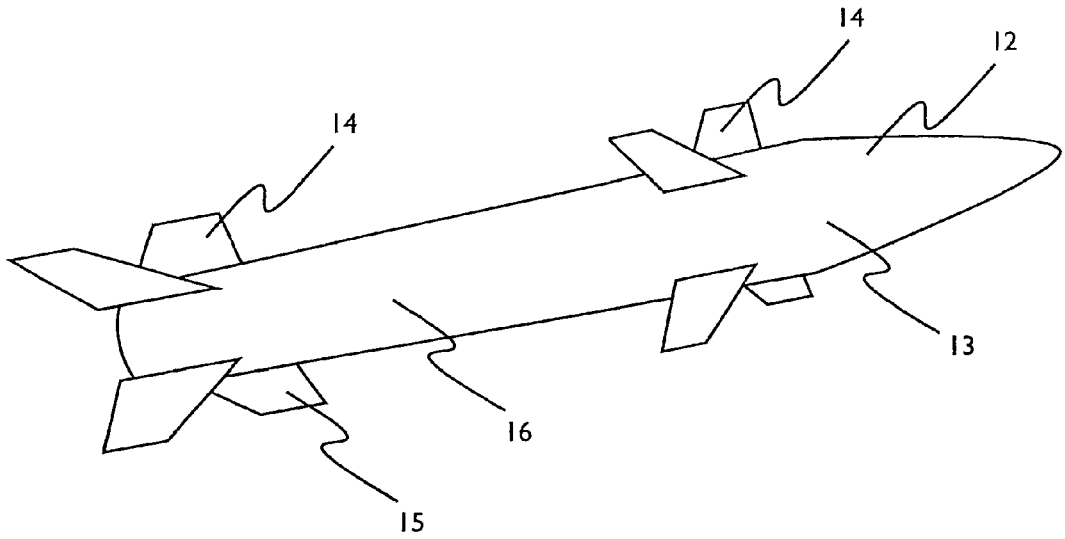
FIG. 1. Isometric view of one embodiment of a missile having a number of control surfaces.

The present invention relates to an aircraft, missile, projectile, or underwater vehicle with an improved control system and to an improved control system for maneuvering an aircraft, missile, projectile or underwater vehicle. More particularly the present invention relates to these aircraft, missiles, projectiles or underwater vehicles with removable and variable control surfaces for adaptively modifying stability. More particularly, the present invention relates to an aircraft, missile, underwater vehicle or projectile with removable control surfaces which also affects maneuvering performance, in-flight.

The aircraft, missile, projectile, or underwater vehicle of the present invention can be any one of those devices with the improved control system described in this application. Underwater vehicles include, but are not limited to torpedoes and submarines. Projectiles include but are not limited to large caliber bullets, shells, bombs and bomblets. The control system, alone or as part of the aircrafts, missiles, under water vehicles or projectiles described in various other embodiments of the present invention, preferably allows the user of these vehicles or devices to change their center of pressure of the device in flight or in the case of an underwater vehicle such as a torpedo or submarine, after firing or during operations respectively.

The vehicle comprises a body and at least one control surface, wherein all or part of the at least one surface is removable. The removable control surface being removable in flight, after launching or during operation. The removable control surface of the present invention comprises at least one removable control surface, a mechanism for attaching the at least one removable control surface to another surface and at least one non-removable surface or for attaching the removable control surface. Preferably the control systems of the various embodiments of the present invention contain a number of removable control surfaces which will improve the versatility and maneuverability of the aircraft, missile, projectile, or underwater vehicle upon which the control system is preferably used. Still preferably, the control system contains at least two control surfaces with accompanying connection mechanisms or connectors. More preferably, the control system contains at least three removable control surfaces with accompanying connection mechanisms or connectors. Still more preferably, the control system contains at least four control surfaces with accompanying connection mechanisms or connectors. Most preferably, the control system contains at least six control surfaces with accompanying connection mechanisms or connectors. In various embodiments of the present invention multiple control surfaces can connect using a single or multiple connection mechanism(s) or connector (s).

The control surfaces and removable control surfaces of the present invention are any surface attached to the aircraft, missile, projectile, or underwater vehicle, which affects the center of pressure of the device. Examples include, but are not limited to wings, fins, stabilizers and control planes specifically for underwater vehicles.

The connection mechanism or connector of the present invention connects the removable control surface to a connection surface. The connection surface can be either the body of the aircraft, missile, projectile or underwater vehicle, a non-removable control surface or another removable control surface. Connection mechanisms or connectors can include, but are not limited to adhesives, exploding bolts, mechanical weaknesses, clamps, hinges, screws, magnets, etc. The connection mechanism or connectors must be able to securely fasten the removable control surface to a connection surface and detach the removable control surface when directed to by the control system or by the user. Activating the connection mechanisms or connectors may be accomplished by a number of mean, each according to the specific type of connection mechanism or connectors. Electrical motors, pneumatics or hydraulics may be used to activate clamps, hinges or screws or an electrical charge can activate exploding bolts or magnets. Any number of connection mechanisms or connectors may be used to connect the removable control surface to the connection surface. The number and placement of connection mechanisms may vary from one mechanism at one point along the connection surface to multiple connection mechanisms at multiple points along the connection surface. The number, type and configuration of connection mechanisms or connectors and the manner in which they are released will vary depending on the specific application and will be apparent to those skilled in the art. Once the removable control surfaces have been released, they will be pulled away from the body of the aircraft, missile, projectile or underwater vehicle by the drag of the fluid through which they are moving, e.g. air or water.

One embodiment of the present invention will have multiple removable control surfaces, that when attached, form one control surface. Each removable control surface preferably is individually addressable and can be removed at separate times in flight, after firing or during operation. Alternatively, multiple control surfaces may be released by activating one or a set of connection mechanisms. Multiple removable control surfaces provide the aircraft, missile, projectile or underwater vehicle with multiple states of stability. The multiple removable control surfaces can be also configured so that they are forward and aft of each other, medially and laterally of each other or any other positioning specific to the desired application.

The connection mechanisms are preferably activated by an onboard control system. The control system can be for example a proportional-integral-derivative (PID) controller, an adaptive predictive controller, an adaptive predictive feedback controller or another computer-controller. The controller of the present invention is preferably a closed loop control system. The system monitors parameters from sensor or other devices outputs and analyzes the data to determine whether any changes to the stability of the aircraft, missile, underwater vehicle or projectile need to be made. Sensors or other devices can be located onboard or located remotely. Devices can include, but are not limited to GPS, radar, altimeter, barometer, IR, RF, and transmitter beacons. Sensors can include, but are not limited position, speed, distance, airflow and pressure. The output of these sensors or other devices are used to determine when, which and what number of connection mechanisms must be actuated thus allowing the specified control surfaces to be removed.

The sensor or device transmits a signal to the controller through either an electrical connection or by a wireless communication (e.g. IR, RF, satellite, etc.) Multiple sensors and/or devices send multiple signals to the controller or multiple controllers. The controller(s) processes the signal(s) to determine, through mathematical modeling, the dynamics of the aircraft, missile, projectile, or underwater vehicle. It is the predictive ability of the controller, which expands this system from being merely responsive to being predictive. This is especially advantageous for dynamic systems, which are nonlinear and time varying and operating in dynamic environments. The controller is preferably a computer or microprocessor. The controller produces an output signal to an actuator, monitor, recorder, alarm and/or any peripheral device for alarming, monitoring, or in some manner, affecting or more rapidly adjusting the dynamics upon its incipience. Preferably, the output of the controller is used to activate the connection mechanisms used to release the removable control surfaces. Advantageously, the controller is the ORICA™ controller, an extended horizon, adaptive, predictive controller produced by Orbital Research Inc. and patented under U.S. Pat. No. 5,424,942, which is incorporated herein by reference. Under certain conditions, the controller (or optionally an external controller) which is preferably connected via electrical or hydraulic connection to the connection mechanisms, causes the connection mechanisms to activate, releasing the removable control surfaces. The control system can also be a partially closed loop control system, which accepts input from not only the sensor(s) or device(s), but from other systems as well and additionally human input.

FIG. 1 is an isometric view of one embodiment of a missile 12 having a number of control surfaces 15. In FIG. 1, the missile 12 has fins 14 on its forebody 13 and aftbody 16. Depending on this missile's 12 configuration either or both the fins 14 on the forebody 13 and aftbody 16, or portions thereof, being removable (not shown).

Figure 2:
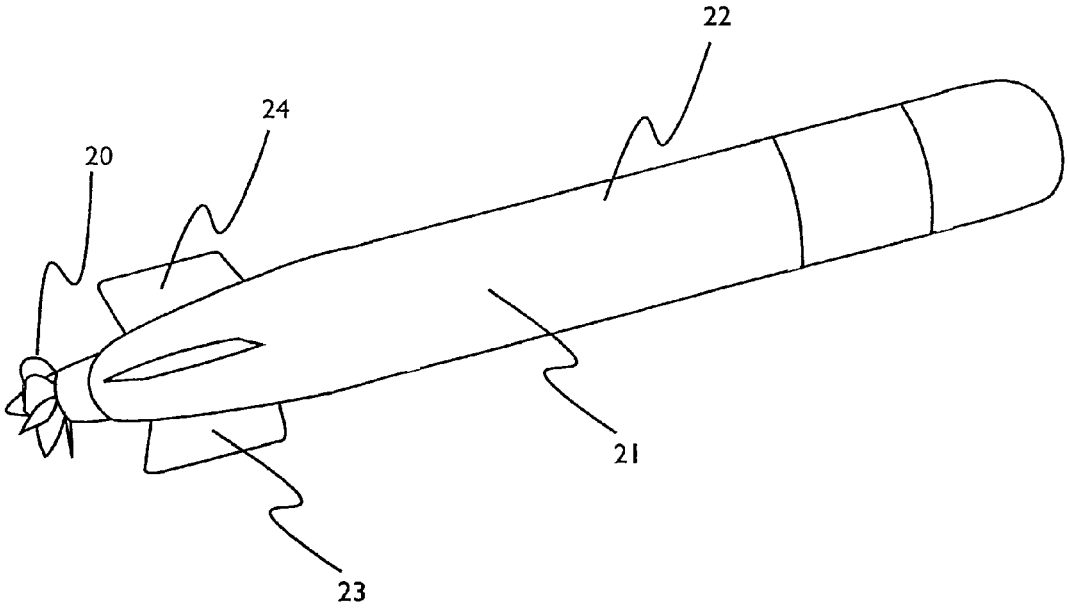
FIG. 2. Isometric view of one embodiment of an underwater vehicle having a number of control surfaces.

FIG. 2 is an isometric view of one embodiment of a torpedo 22 having a number of control surfaces 23 on its aft body 21. In FIG. 2, the torpedo 22 has four fins 24 (one not shown) on its aft body 21 along with a propeller 20 for driving the torpedo 22. At least one of the torpedo fins 24 or control surfaces 23 being removable (not shown).

Figure 3:
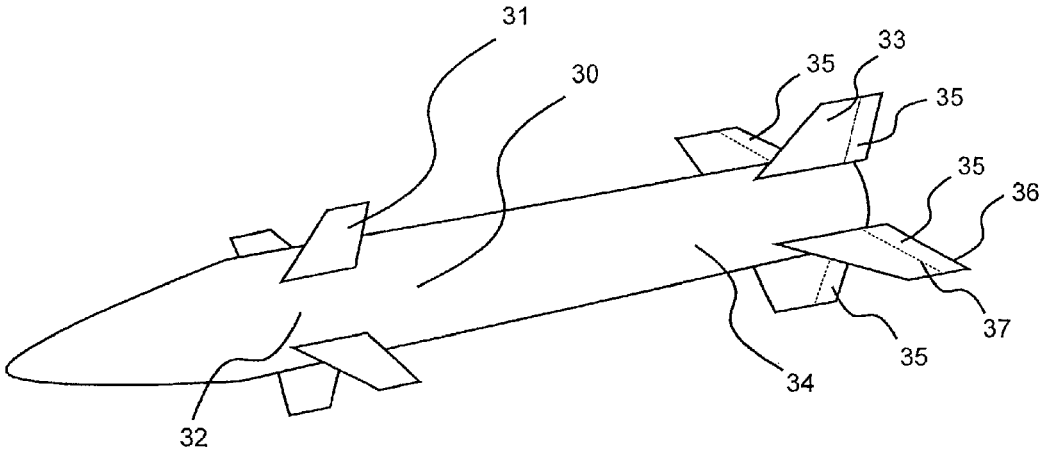
FIG. 3. Isometric view of one embodiment of the aft body of a missile with removable fins.

FIG. 3 is an isometric view of one embodiment of a missile 30 having four fins 31 on its forebody 32 and four fins 33 on its aftbody 34. The fins 33 on the missile's aftbody 34 contain removable control surfaces 35 on their trailing edge 36. These fins 33 have a mechanical weakness 34 built into the fins 33, which functions as the connecting mechanism or connector 34. This mechanical weakness 34 allows the fins to be detached using small controlled explosives (not shown) to detach the removable portion of the fin 35. These small controlled explosives are actuated by either a controller or by human intervention.

Figure 4:
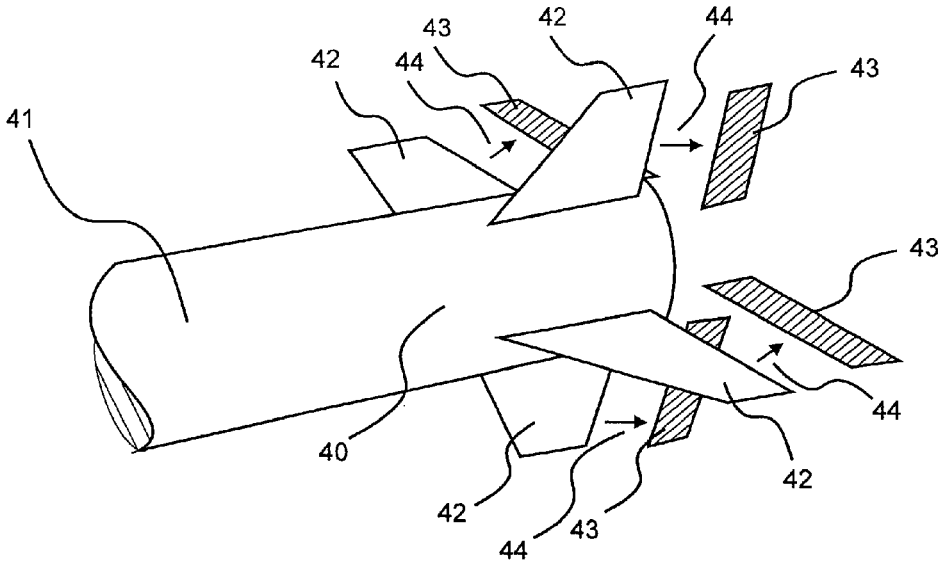
FIG. 4. Cutaway isometric view of the embodiment in FIG. 3 of the aft body of a missile having a number of removable fins that have been removed.

FIG. 4 is a cutaway isometric view of the aft portion 40 of a missile 41. In FIG. 4, the four aft fins 42 are shown with their respective removable control surfaces 43 detached. The four arrows 44 illustrate the direction and movement of the removable control surfaces 43 once they are detached from the aft fins 42.

Figure 5:
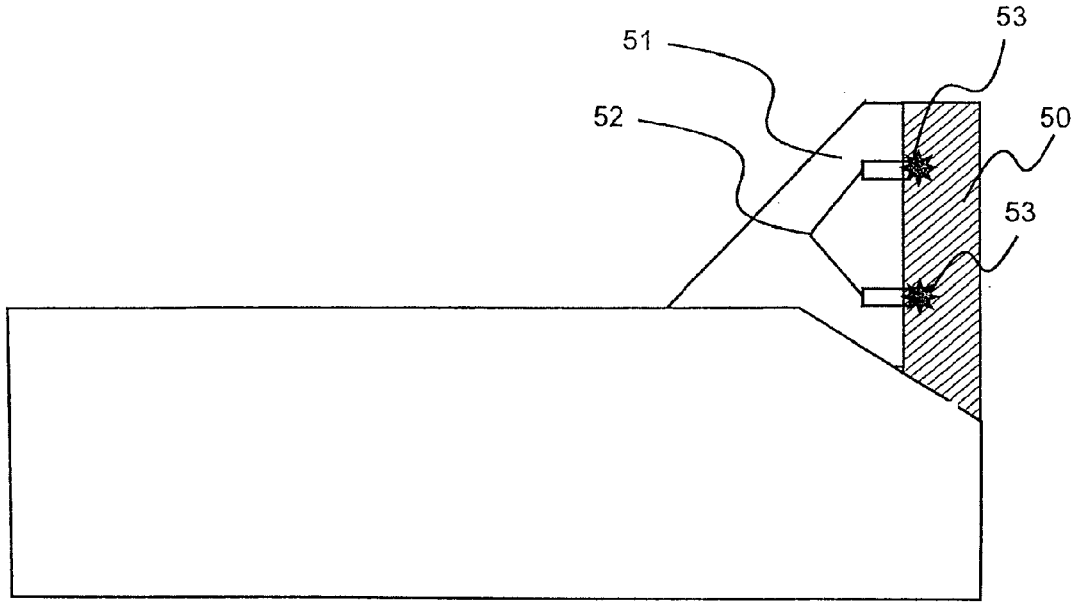
FIG. 5. Cross sectional partial cutaway of an aircraft vertical stabilizer with attached removable control surface. The removable control surface is attached to the vertical stabilizer with two exploding bolts.

FIG. 5 is a cross sectional partial cutaway of an aircraft's stabilizer 51 with attached removable control surface 50. The removable control surface 50 is attached to the stabilizer 51 by exploding bolts 52. When the aircraft's pilot (not shown) or controller (not shown) determines a need for a change in stability is necessary, it sends an electric charge to the exploding bolts 52. The electric charge causes the exploding bolts 52 to detonate 53. The detonation 53 severs the connection between the stabilizer 51 and removable control surface 50 and allows the removable control surface 50 to detach. This alters the center of pressure towards the front of the aircraft and increases the maneuverability.

Figure 6:
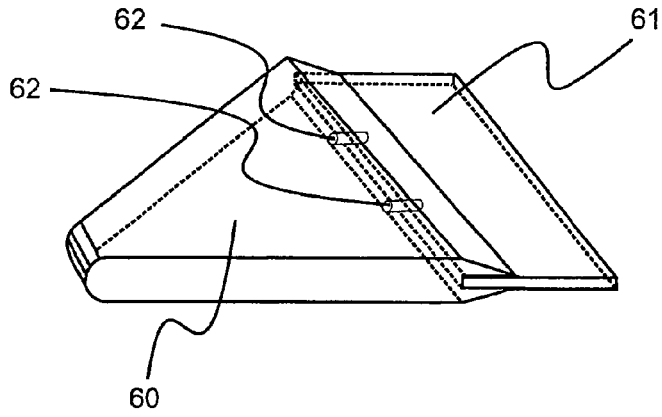
FIG. 6. Isometric view of the tip of an aircraft wing or missile fin with a removable trailing edge. The trailing edge is connected to the wing or fin by two bolts.

FIG. 6 is a transparent isometric view of the tip of an aircraft wing or missile's fin 60 with a removable trailing edge 61. The trailing edge 61 is connected to the wing or fin 60 by two bolts 62. The bolts 62 are unscrewed from either the wing or fin 60 or the trailing edge 61 to release the trailing edge 61. Pneumatics, electrical motors or hydraulics (not shown) can be used to unscrew the bolts 62. The bolts 62 are preferably released from the wing or fin 60 and remain attached to the trailing edge 61 when released.

Figure 7:
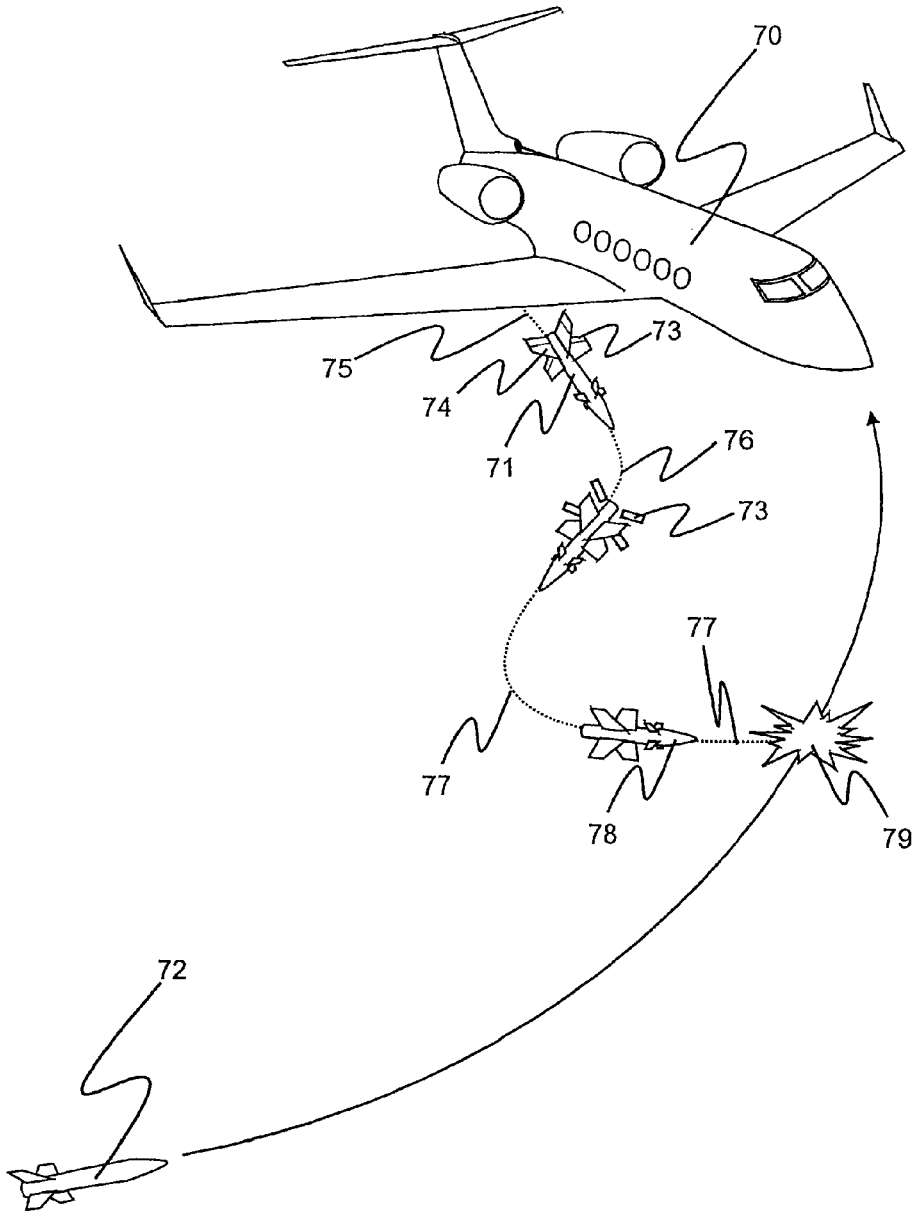
FIG. 7. Schematic view of various stages of a missile fired from an aircraft to intercept and destroy an incoming missile, showing the removable control surfaces being removed during flight.

FIG. 7 is a schematic view of various stages of a missile 71 fired from an aircraft 70 to intercept 79 and destroy an incoming missile 72, showing the removable control surfaces 73 being removed during flight. In FIG. 7, a missile 71 is fired from an aircraft 70. When fired, the missile 71 has the removable control surfaces 73 attached to the rear sections of the missile's 71 rear fins 74. The missile 71 is fired from the aircraft's 70 underbody (not shown). The missile's 71 flight can be broken up into three stages. The first flight stage is missile launch 75. Missile launch 75 subjects the missile 71 to high cross-winds which require the missile 71 to have full control surfaces 73 for stability. The second flight stage is approach 76. During the approach stage the missile 71 flies towards the incoming missile 72. Approach 76 is characterized by fairly straight flight requiring stability, but not as much as launch 75. The approach 76 distance may vary greatly from many miles down to feet and in certain situations, may not be present. The third and final flight stage is interception 77. During the interception 77 stage the missile 71 requires great maneuverability to intercept 79 the incoming missile 72. The removable control surfaces 73 are shed to permit the missile 71 increased maneuverability. The missile's 71 final configuration 78 is minus the removable control surfaces. The interception stage 77 is characterized by multiple, sharp maneuvers.

Figure 8:
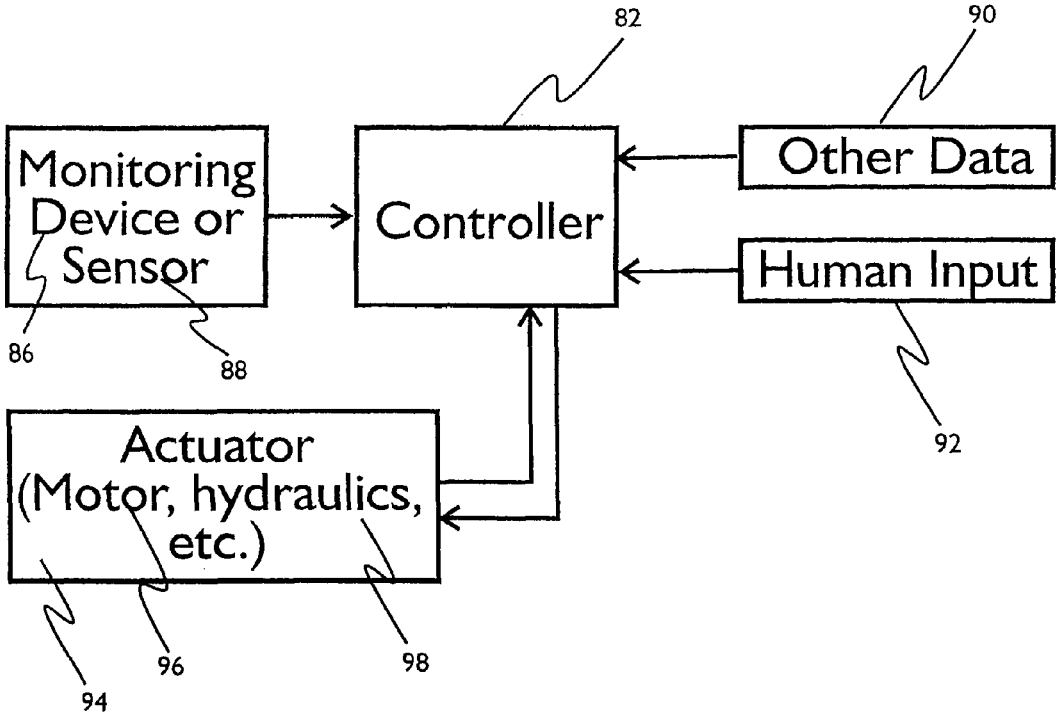
FIG. 8. Schematic flow diagram of removable control surfaces for aircraft, missiles, projectiles, or underwater vehicles of the present invention.

FIG. 8 is a schematic flow diagram of removable control surfaces for aircraft, missile, underwater vehicles or projectiles of the present invention. In FIG. 8, a controller 82 accepts input from a monitoring device 86 or sensor 88, other data from various sources and/or human input 92. The controller 82 based at least in part on the input from a monitoring device 86 or a sensor 88 actuates a device 94 to remove the removable control surface. This actuator for example can be a motor 96 or hydraulics 98, which causes this movement.

What is claimed:

1. A method of increasing the maneuverability or increasing the stability of an aircraft, missile, underwater vehicle, or projectile comprising steps of:

causing the aircraft, missile, underwater vehicle, or projectile to take off, launch, or otherwise be released into a designed path of travel, the aircraft, missile, underwater vehicle, or projectile comprises a body, at least two control surfaces, and a sensor or device for detecting changes in condition, and wherein the sensor or device has an output;

detecting with the sensor or device a change in condition requiring increased maneuverability or increased stability;

outputting from the sensor or device a signal indicating the change of condition detected; and reducing or eliminating at least one of the at least two control surface to increase maneuverability or increase stability of the aircraft, missile, underwater vehicle or projectile based at least in part on the output of the sensor or device.

2. The method of claim 1 wherein the sensor or device is a GPS.

3. The method of claim 1 wherein the sensor or device is a radar.

4. The method of claim 1 wherein the sensor or device is an infra-red device.

5. The method of claim 1 wherein the aircraft, missile, underwater vehicle, or projectile further comprises a closed-loop control system and wherein the closed-loop control system causes the at least one control surface to be reduced or eliminated based at least in part on the output from the sensor or device.

6. The method of claim 1 wherein multiple removable control surfaces when attached form one control surface of the at least two control surfaces and wherein the multiple removable control surfaces provide multiple states of stability.

7. The method of claim 1 where the sensor or device transmits wirelessly via a satellite.

8. A method of increasing the maneuverability or increasing the stability of an aircraft, missile, underwater vehicle, or projectile comprising steps of:

causing the aircraft, missile, underwater vehicle, or projectile to take off, launch, or otherwise be released into a designed path of travel, the aircraft, missile, underwater vehicle, or projectile comprises a body, and at least two control surfaces;

reducing or eliminating at least one of the at least two control surfaces to increase maneuverability or increase stability by removing at least part of the at least one control surface.

9. The method of claim 8 wherein the aircraft, missile, underwater vehicle, or projectile comprises at least two control surfaces.

10. The method of claim 8 wherein part or all of the at least one control surface is removed by exploding a releasable connector which connects the part of the at least one control surface to the rest of the control surface.

11. The method of claim 8 wherein part or all of the at least one control surface is reduced or removed by releasing a clamp which holds the part of the at least one control surface to the rest of the control surface.

12. The method of claim 8 wherein part or all of the at least one control surface is reduced or removed by removing a hinge which connects the part of the at least one control surface to the rest of the control surface.

13. The method of claim 8 wherein part of the at least one control surface is reduced or removed by exploding a bolt which connects the part of the at least one control surface to the rest of the control surface.

14. A missile or projectile comprising a body and at least one control surface wherein the area of the at least one control surface can be varied in flight to increase maneuverability or increase stability during flight in response in part to a signal from a sensor or device.

15. The missile or projectile of claim 14 wherein the missile or projectile comprises at least two control surfaces.

16. The missile or projectile of claim 14 further comprises a closed-loop control system and wherein the closed-loop control system causes the shape of the at least one control surface to be reconfigured based at least in part on the output from the sensor or device.

17. The missile or projectile of claim 16 wherein the closed loop control system is a proportional-integral-derivative controller, an adaptive predictive controller or an adaptive predictive feedback controller.

18. The missile or projectile of claim 14 wherein the device or sensor is an infra-red sensor.

19. The missile or projectile of claim 14 wherein the device or sensor is a GPS device.

* * * * *